US006072133A

United States Patent [19]

Takagi et al.

[11] Patent Number: 6,072,133

[45] Date of Patent: Jun. 6, 2000

[54] ELONGATED KEY SUPPORT MECHANISM

[75] Inventors: Takeyuki Takagi, Nagoya; Isao Mochizuki, Kaizu-gun, both of Japan

[73] Assignee: Brother Kogyo Kabushiki Kaisha, Nagoya, Japan

[21] Appl. No.: 09/020,913

[22] Filed: Feb. 9, 1998

[30] Foreign Application Priority Data

Feb. 10, 1997 [JP] Japan ..... 9-026301

[51] Int. Cl.[7] ..... H01H 13/70

[52] U.S. Cl. ..... 200/344; 200/341

[58] Field of Search ..... 200/341–344

[56] References Cited

U.S. PATENT DOCUMENTS

| | | | |
|---|---|---|---|
| 5,630,501 | 5/1997 | Tsay | 200/344 |
| 5,746,308 | 5/1998 | Lin | 200/344 |
| 5,747,758 | 5/1998 | Hochgesang et al. | 200/5 A |
| 5,767,464 | 6/1998 | Dyer et al. | 202/5 A |
| 5,767,468 | 6/1998 | Tsai | 200/344 |
| 5,819,914 | 10/1998 | Yoneyama | 200/344 |
| 5,823,325 | 10/1998 | Lin | 200/344 |
| 5,878,872 | 3/1999 | Tsai | 200/344 |
| 5,898,145 | 4/1999 | Su | 200/344 |

FOREIGN PATENT DOCUMENTS 6-36648 2/1994 Japan .

*Primary Examiner*—Michael L. Gellner
*Assistant Examiner*—Nhung Nguyen
*Attorney, Agent, or Firm*—Oliff & Berridge, PLC

[57] ABSTRACT

An elongated key switch 1 includes a key top 2 and a guide support member 5 supporting the key top 2. The guide support member 5 includes connection members 3*c*, 4*c* formed in a thick plate or rod shape to provide them which high rigidity. The connection member 3*c* is provided with a press-down portion that directly presses down on a rubber spring to perform a switching operation. To insure that the connection member 3*c* is sufficiently rigid so that the switching operation can be performed, metal wire 3*g* having rigidity is press fitted in a lengthwise direction of the connection member 3*c*. Accordingly, even when a lengthwise end portion of the key top 2 is pressed down, the connection members 3*c*, 4*c*, particularly the connection member 3*c* that presses directly on the rubber spring, will not bend. As a result, switching operations can be accurately performed.

20 Claims, 9 Drawing Sheets

ELONGATED KEY SUPPORT MECHANISM

BACKGROUND OF THE INVENTION

1. Field of the Invention

The present invention relates to an elongated key support mechanism including a guide mechanism having two mutually coupled link members for supporting an elongated key, such as a space key, and for guiding vertical movement of a key top of the elongated key by scissors-like movement of the guide mechanism.

2. Description of the Related Art

Japanese Laid-Open Patent Publication No. HEI-6-36648 discloses an elongated key support mechanism 100 shown in FIG. 1. The elongated key support mechanism 100 includes: an elongated key top 101 formed elongated in a lengthwise direction, a holder member 130, and a guide support mechanism 106 disposed between the key top 101 and the holder member 130. The guide support mechanism 106 is for supportingly guiding vertical movement of the elongated key top 101 and includes two hinge-like members 107, 108 that are pivotably supported about a common axis so as to open and close in a scissors-like manner to enable vertical movement of the key top 101.

As shown in FIG. 2, the hinge member 107 is formed in a substantial C shape. The hinge member 107 includes a connection rod 113 formed to a length corresponding to the length of the elongated key top 101 and a pair of link members 109 provided at opposite ends of the connection rod 113. The connection rod 113 and the pair of link members 109 are integrally formed together. An axial protrusion 112 is provided to a substantially central position of each of the link members 109. The axial protrusions 112 protrude inward toward each other.

As shown in FIG. 3, the hinge member 108 of the guide support member 106 includes a connection rod 121 and a pair of link members 117 provided at opposite ends of the connection rod 121. The connection rod 121 and the pair of link members 117 are formed integrally together. The connection rod 121 is formed to a length corresponding to the length of the elongated key top 101 so that the pair of link members 117 are separated by distance corresponding to the length of the elongated key top 101. The hinge member 108 further includes a depression bar 118 connected between the link members 117 at the substantial center of opposing surfaces of the link members 117. The depression bar 118 is integrally formed with the link members 117. An axial hole is formed near the center of an outward facing edge of each link member 117.

When the elongated key support mechanism 100 is assembled, the pair of axial protrusions 112 are pivotably fitted in corresponding ones of the pair of axial holes 120 so that the hinge members 107, 108 of the guide support member 106 are freely openable and closable in a scissors-like manner. As shown in FIG. 4, the depression bar 118 is mounted on an upper surface of a rubber spring 131 so that when the elongated key top 101 is pressed downward, the hinge members 107, 108 pivot in a scissors-like manner in association with downward movement of the elongated key top 101. As a result, the rubber spring 131 is compressed downward so that electrical contact is achieved to perform a switching operation.

SUMMARY OF THE INVENTION

However, the depression bar 118 for pressing down on the rubber spring 131 is easily bent because it has a slender shape. Therefore, is a user were to press down on the elongated key top 101 at an end portion, particularly the right end as viewed in FIG. 4, the depression bar 118 will bend greatly so that a proper switching operation can not be performed.

Bending of the depression bar 118 in this manner can conceivably be prevented by forming the depression bar 118 thick so it has greater rigidity. However, the depression bar 118 must be sufficiently small to fit within the elongated key top 101 when the elongated key top 101 is completely pressed down, otherwise the depression bar 118 will interfere with stroke of the key top 101. Therefore, the depression bar 118 can be formed no greater than a certain thickness.

It is an objective of the present invention to overcome the above-described problems and to provide an elongated key support mechanism capable of performing proper switching operations even when the elongated key is pressed at one tip end in the lengthwise direction thereof.

In order to achieve the above-described objectives, an elongated key support mechanism according to the present invention includes: an elongated key top, a first holding portion, a second holding portion, a holder member, and a guide support member.

The elongated key to has a length extending in a lengthwise direction and a width extending in a widthwise direction, wherein the length is greater than the width. The key top has two widthwise edges opposite each other with respect to the widthwise directions. The key top also has a lower surface.

The first holding portion is provided on the lower surface of the key top adjacent to one of the widthwise edges. The second holding portion is provided on the lower surfaces of the key top adjacent to another of the widthwise edges. The holding member has a third holding portion confronting the first holding portion and a fourth holding portion confronting the second holding portion.

The guide support member includes a first and second pair of link members and a first and second connection member. The first pair of link members is supported between the first and fourth holding portions and are connected together by the first connection member, which extends in the lengthwise direction. The second pair of link members are supported by the second and third holding portions and are connected together by the second connection member, which also extends in the lengthwise direction. The first and second pairs of link members are coupled together to enable scissor-like pivoting movements of the first and second pairs of link members to guide movement of the key top toward and away from the holder member. At leas tone of the first and second connection members has a rigidity greater than rigidity of any link member of the first and second pairs of link members.

With this configuration, the guide support member moves downward when the key top is pressed downward because the first and the second link members of the guide support member move, such as by pivoting or rotating, with respect to first through fourth holding members holding members provided to the holder member and to the lower surface of the key top. Because at least one of the first and second connection members, which connect the first pair of link members together and the second pair of link members together, respectively, is formed with a large rigidity, even when the lengthwise end of the elongated key top is depressed, a proper switching operation can be performed without a connection members bending excessively. In addition, because the link members have a relatively low rigidity, assembly of the key support mechanism is easy. A switching member can be provided so that a switching operation is performed by the switching member in association with downward movement of the guide support member.

According to another aspect of the present invention, rigidity of the at least one of the connection members is increased by providing the at least of the one connection members with a rigid member. As a result, a proper switching can be performed even when the user pressed down on the lengthwise end of the key top.

According to another aspect of the present invention, the at least one of the connection members is formed from a resin material and the rigid member is formed from a metal material. Although a connection member formed from a resin material can easily bend, when the rigid member for increasing rigidity of the connection member is formed from a metal material in this way, bending of the connection member can be prevented.

BRIEF DESCRIPTION OF THE DRAWINGS

The above and other objects, features and advantages of the invention will become more apparent from reading the following description of the preferred embodiment taken in connection with the accompanying drawings in which:

FIG. 5(*b*) is a plan view partially in phantom showing the key switch according to a first embodiment;

DETAILED DESCRIPTION OF THE PREFERRED EMBODIMENTS

Figure 1:
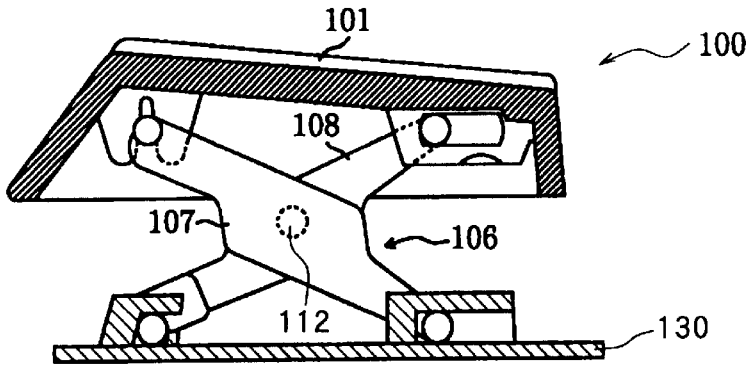
FIG. 1 PRIOR ART
FIG. 1 is a cross-sectional side view showing a conventional elongated key support mechanism.
Figure 2:
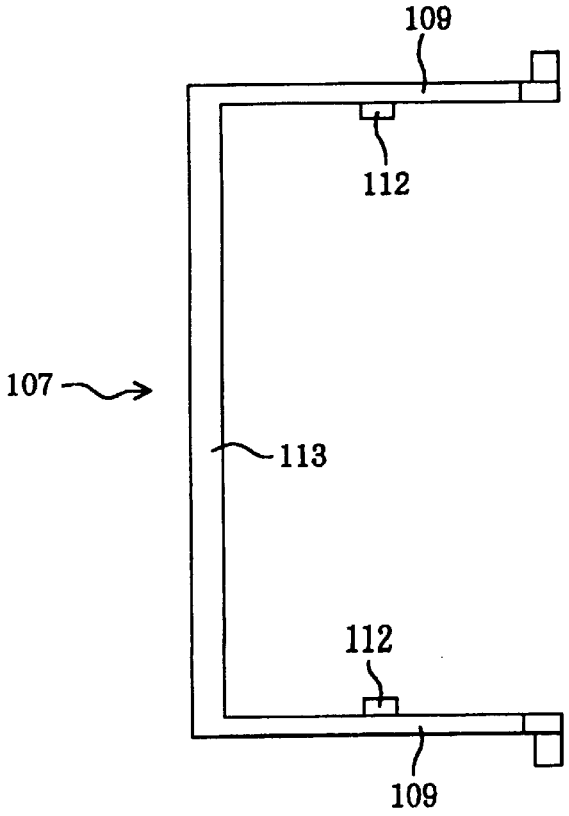
FIG. 2 PRIOR ART
FIG. 2 is a plan view showing one hinge member of the conventional elongated key support mechanism shown in FIG. 1.
Figure 3:
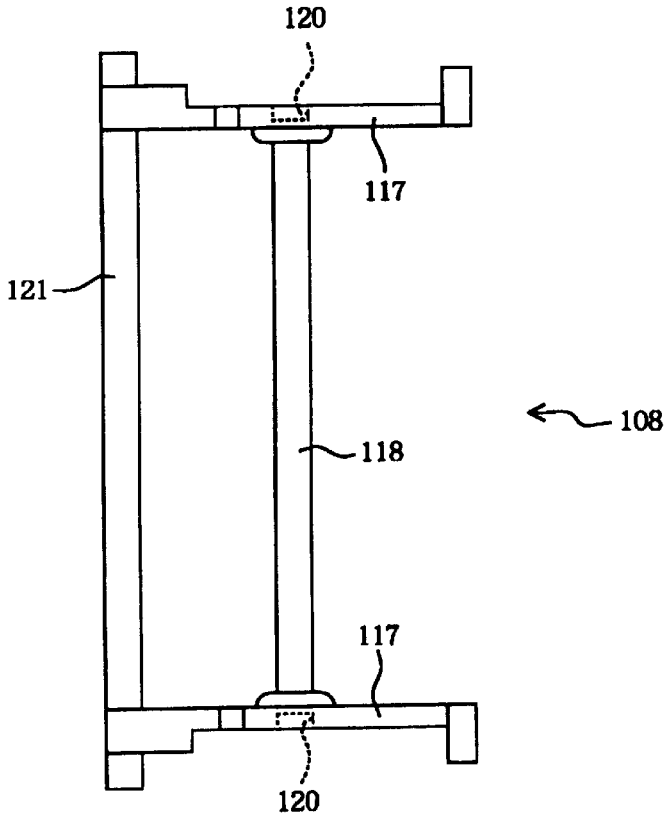
FIG. 3 PRIOR ART
FIG. 3 is a plan view showing another hinge member of the conventional elongated key support mechanism shown in FIG. 1.
Figure 4:
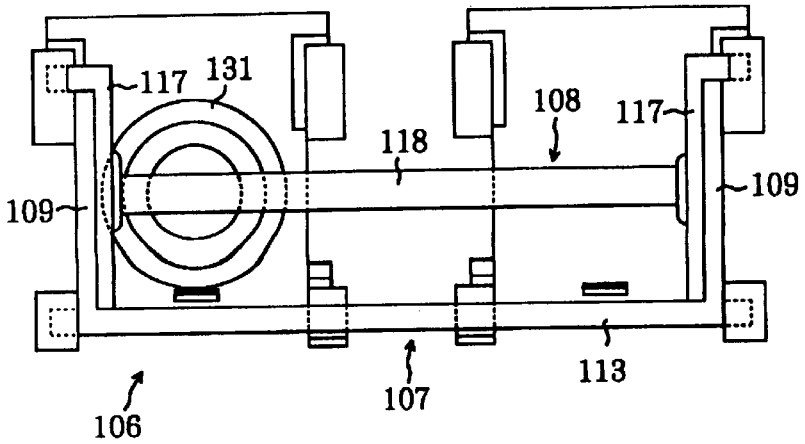
FIG. 4 PRIOR ART
FIG. 4 is a plan view showing the elongated key support mechanism of FIG. 1 without a key top.

An elongated key support mechanism according to a preferred embodiment of the present invention will be described while referring to the accompanying drawings wherein like parts and components are designated by the same reference numerals to avoid duplicating description.

Figure 5:
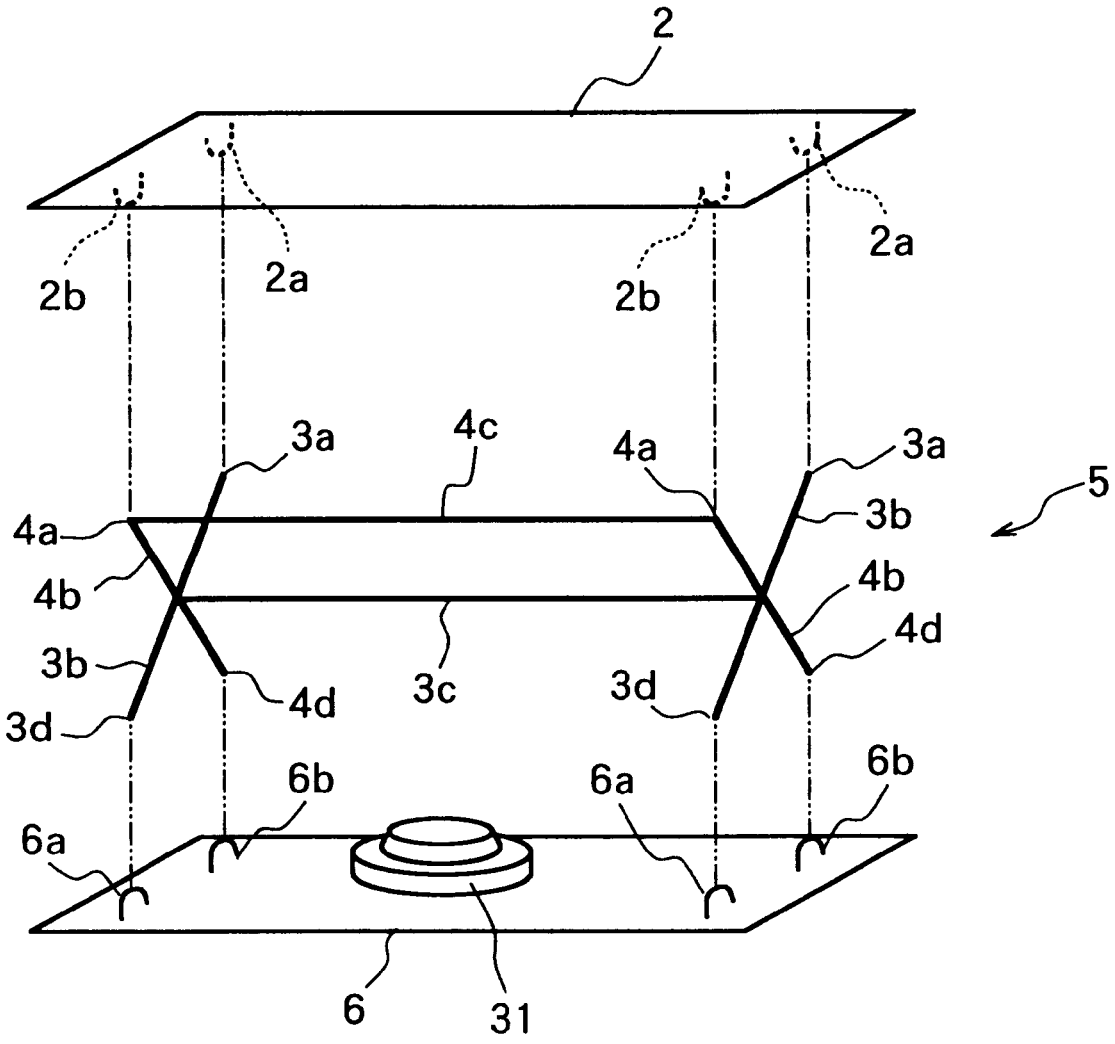
FIG. 5(*a*) is a schematic view showing a key switch according to a first embodiment of the present invention.
Figure 5:
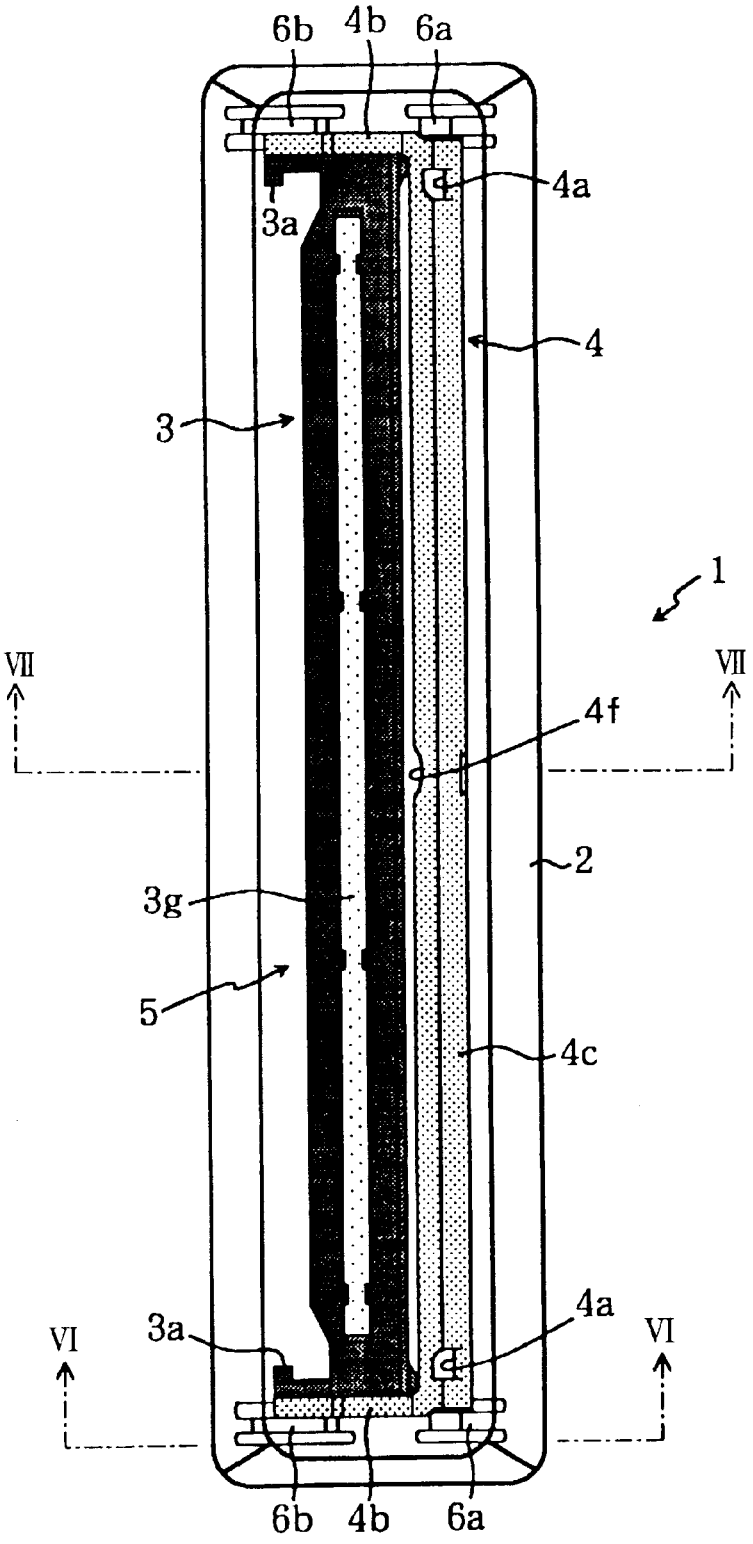

The present embodiment describes a key switch 1, such as a space key of a key board. As shown in FIGS. 5(*a*), 5(*b*), and 6, the key switch 1 includes an elongated key top 2, a guide support member 5, and a holder member 6. The guide support member 5 supports and guides vertical movement of the key top 2 and includes hinge members 3 and 4. The holder member 6 is formed with a pair of third holding portions 6*a*, 6*a* and a pair of fourth holding portions 6*b*, 6*b* for each key switch of the keyboard, although only one pair of holding portions 6*a*, 6*a* and one a pair of holding portions 6*b*, 6*b* are shown in the drawings.

The elongated key top 2 is formed from a resin material such as ABS resin. As shown in FIG. 5(*a*), pair of first holding portions 2*a* and a pair of second holding portions 2*b* are formed to the lower surface 2*c* of the key top 2. As will be described in further detail later, the pair of first holding portions 2*a* slidingly support a pair of holding pins 3*a* of the hinge member 3 so that the pair of holding pins 3*a* are slidable in the horizontal direction. Further, the pair of second holding members 2*b* are pivotably supported in a pair of holding holes 4*a* of the hinge member 4 (see FIG. 11). A rubber spring 31 is disposed on the holder member 6 near the lengthwise center of the key top 2.

Figure 9:
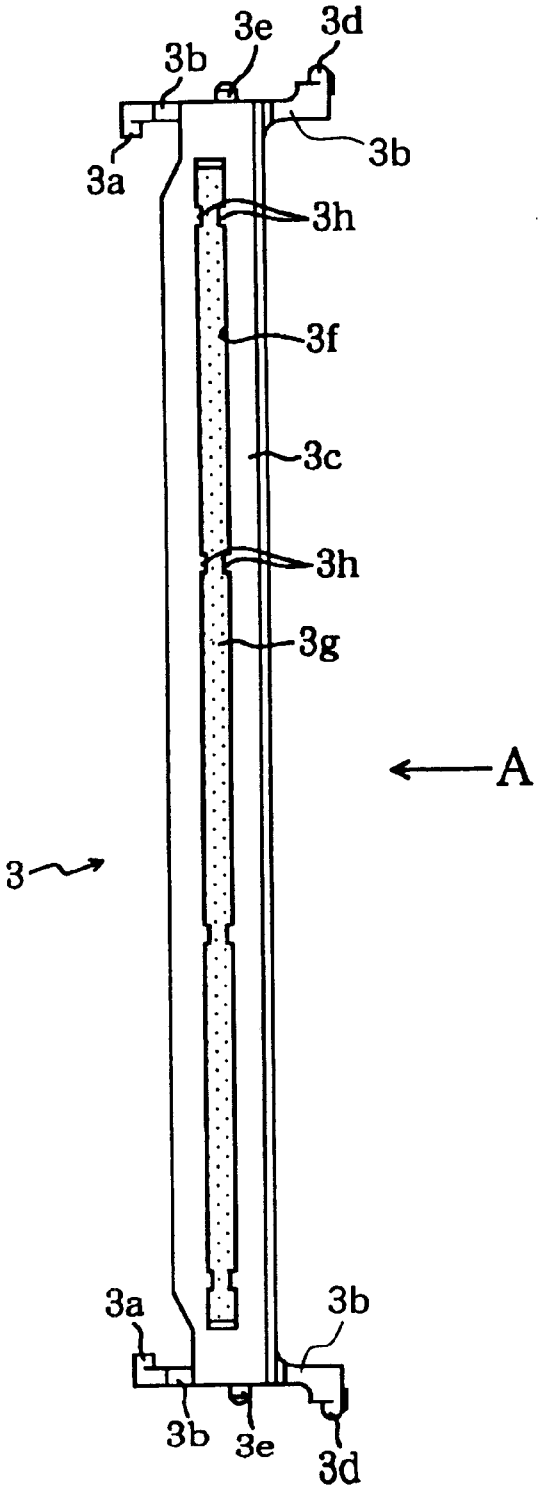
FIG. 9 is a plan view showing a hinge member of the key switch shown in FIG. 5(*b*)
Figure 10:
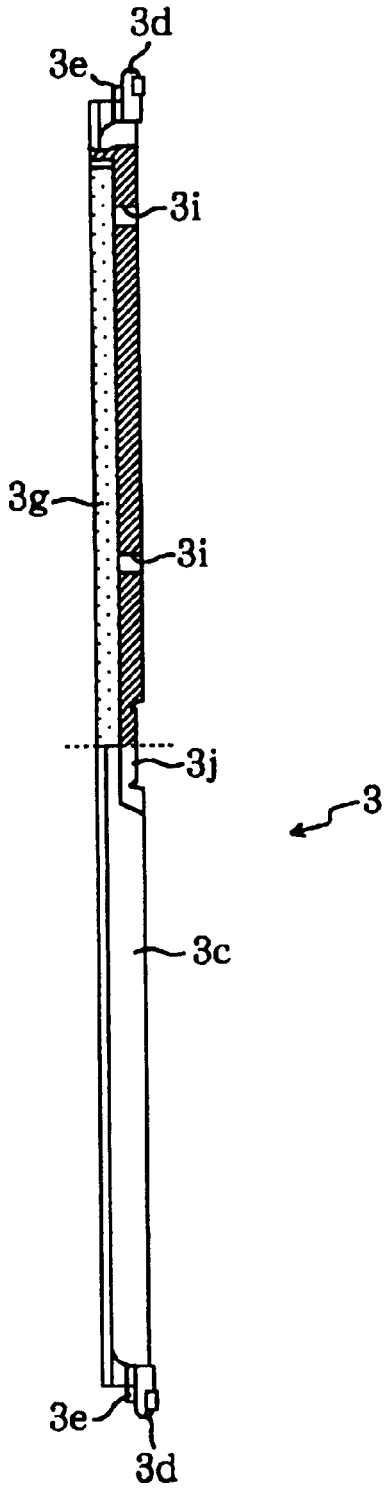
FIG. 10 is a side view of the hinge member in FIG. 9 as viewed in a direction indicated by an arrow A in FIG. 9.

FIG. 9 is a plan view showing the hinge member 3 of the guide support member 5. FIG. 10 is a side view in partial cross section showing the hinge member 3 viewed from a direction indicated by an arrow A in FIG. 9. As shown in FIG. 9 the hinge member 3 includes a connection member 3*c*, a pair of slender, rod-shaped link members 3*b*, 3*b* provided at opposite ends of the connection member 3*c*, and two pairs of holding pins 3*a*, 3*d* and has a substantially H shape in a plan view, wherein the connection member 3*c* forms the cross bar of the H. The connection member 3*c* and the rod-shaped link members 3*b*, 3*b* are formed integrally together from resilient polyacetal resin (POM), wherein the link members 3*b*, 3*b* have a slender rod shape, and so are resilient, and the connection member 3*c* is formed into a thick plate shape at its center, and so is more rigid than the link members 3*b*, 3*b*.

Each link member 3*b* is formed with one of the holding pins 3*a* at one tip and with one of the holding pins 3*d* at the opposite tip. The pair of holding pins 3*a*, 3*a* are formed so as to protrude inward toward each other on corresponding link member 3*b*, 3*b* tips, that is, tips that protrude to the left as viewed in FIG. 9. The pair of holding pins 3*d*, 3*d* are formed so as to protrude outward away from each other on corresponding link member 3*b*, 3*b* tips, that is, tips that protrude to the right as viewed in FIG. 9. As mentioned above, the pair of holding pins 3*a*, 3*a* are slidably supported in the first holding portions 2*a* formed to the underside of the key top 2 and the pair of holding pins 3*d*, 3*d* are pivotably supported by the pair of third holding portions 6*a*, 6*a* provided to the upper surface of the holder member 6, which will be described in more detail later. An axial protrusion 3*e* is formed at the substantial center of each of the link members 3*b*, 3*b*. The pair of protrusions 3*e* are formed so as to protrude away from each other in a direction following the lengthwise direction of the connection member 3*c*.

A slender elongated groove 3*f* is formed in the upper surface of the connection member 3*c*. A metal wire 3*g* is press fitted into the groove 3*f*. The wire 3*g* is formed from a highly rigid stainless steel wire, such as the type used for forming springs. Although the connection member 3*c* has considerable rigidity due to its thick plate shape, it is bendable because it is formed from a resin material. Inclusion of the wire 3*g* into the connection member 3*c* by press fitting as in the present embodiment increases the rigidity of the connection member 3*c* so that the bending property of the connection member 3*c* can be prevented.

As shown in the cross sectional portion of FIG. 10, a plurality of holes 3*i* are formed in the connection member 3*c* so as to extend in the thickness direction of the connection member 3*c* from the base of the groove 3*f* to the surface of the connection member 3*c* opposite the groove, that is, to the surface to the right as viewed in FIG. 10. The holes 3*i* allow air to escape out of the groove 3*f* when the wire 3*g* is press fitted into the groove 3*f* so that the wire 3*g* can be easily press fitted into the connection member 3*c*. Four pairs of protrusions 3*h* are formed along edges of the groove 3*f* so as to extend into the groove 3*f*. Corresponding members of each pair of protrusions 3*h* protrude toward each other from opposite edges of the groove 3*f*. The protrusions 3*h* prevent the wire 3*g* from falling out of the groove 3*f* once the wire 3*g* has been press fitted into the groove 3*f*.

As shown in FIG. 10, a trapezoidal depression portion 3*j* is formed near the center at the lower surface of the connection member 3*c*. The depression portion 3*j* is mounted on the upper surface of the rubber spring 31. When the key top 2 is pressed down, the depression portion 3*j* directly presses against the rubber spring 31 so that a switching operation is performed.

Figure 11:
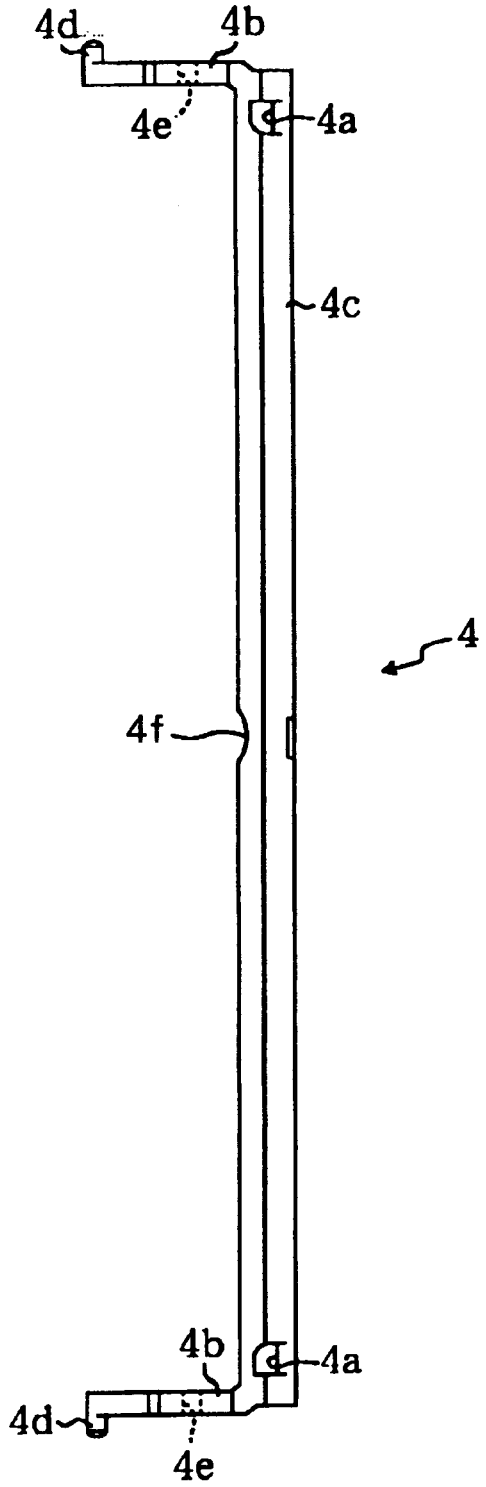
FIG. 11 is a plan view showing another hinge member of the key switch in FIG. 5(*b*)

FIG. 11 is a plan view showing the hinge member 4 of the guide support member 5. As shown in FIG. 11, the hinge member 4 is formed in a substantially C shape in plan view. The hinge member 4 includes a thick rod shaped connection member 4*c* and a pair of slender rod shaped link members 4*b*, 4*b* formed integrally with the connection member 4*c* at opposite ends thereof. The hinge member 4 is formed in an integral shape from resilient polyacetal resin (POM), wherein the link members 4*b*, 4*b* have a slender rod shape, and so are resilient, and the connection member 4*c* has a thick rod shape, and so has greater rigidity than the link members 4*b*, 4*b*.

One of a pair of holding pins 4*d*, 4*d* is formed on free ends of each of the link members 4*b*, 4*b*. The holding pins 4*d*, 4*d* are formed on oppositely facing edges of the link members 4*b*, 4*b* so as to protrude away from each other. The holding pins 4*d*, 4*d* are slidably supported in the pair of fourth holding portions 6*b*, 6*b* provided on the upper surface of the holder member 6 to be described in more detail later.

A pair of axial holes 4*e*, 4*e* are formed through the substantial center of the link members 4*b*, 4*b* so as to penetrate through the link members 4*b*, 4*b* in their thickness direction. The guide support member 5 is configured from the hinge members 3, 4 by fitting the axial protrusions 3*e*, 3*e* of the hinge member 3 into the axial holes 4*e*, 4*e* to enable scissor-like pivoting movements between the hinge members 3, 4.

A holding hole 4*a* is formed near each end of the connection member 4*c*. The holding holes 4*a*, 4*a* are pivotably supported in the holding portions 2*b* formed to the under surface of the key top 2. The portion of the connection member 4*c* between the pair of holding holes 4*a*, 4*a* is formed in a thick shape including an upper portion 4*c*′ and a lower portion 4*c*″ shown in FIG. 5(*b*) to provide the connection member 4*c* with sufficient rigidity. On the other hand, end portions of the connection member 4*c*, that is, portions of the connection member 4*c* other than between the holding holes 4*a*, 4*a*, are provided only with the upper portion 4*c*′ and do not include the lower portion 4*c*″. Therefore, the connection member 4*c* will be sufficiently rigid without fear that the end portions of the connection member 4*c* will abut against the holding pins 3*d*, 3*d* of the hinge member 3 when the key top 2 is pressed downward. Therefore, vertical movement of the key top 2 will not be blocked or stopped during downward movement.

An arc-shaped indentation 4*f* formed to match the outer contour of the rubber spring 31 is formed near the lengthwise center of the connection member 4*c* in an edge facing in the same direction in which the link members 4*b*, 4*b* protrude. The indentation 4*f* enables the connection member 4*c* to move downward in association with the key top 2 without the connection member 4*c* abutting against the rubber spring 31.

Figure 6:
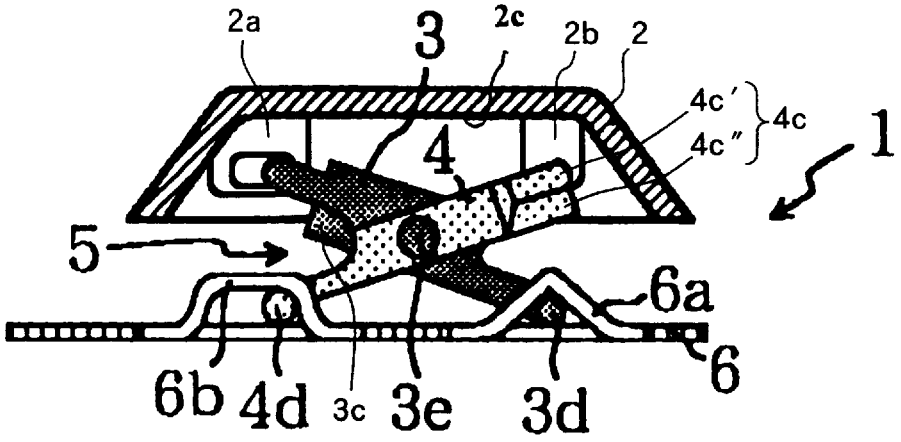
FIG. 6 is a cross-sectional view taken along line VI—VI of FIG. 5(*b*)
Figure 7:
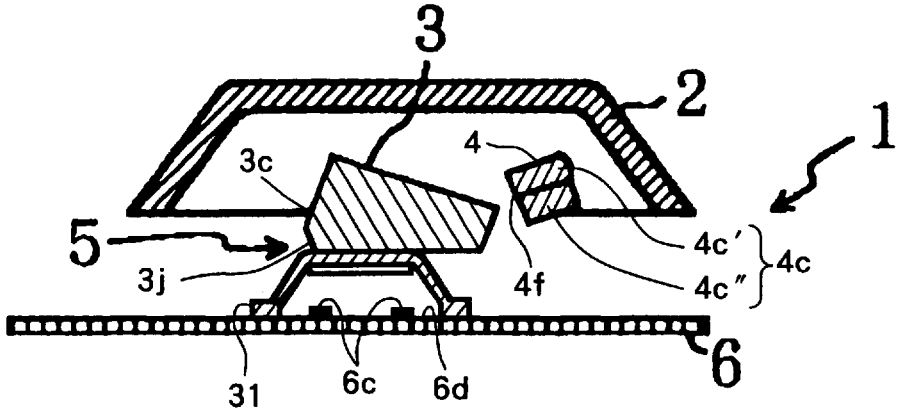
FIG. 7 is a cross-sectional view taken along line VII—VII of FIG. 5(*b*)

As shown in FIG. 6, the holder member 6 is formed form a metal material in a plate shape and is disposed beneath the guide support member 5, which is formed from the pair of hinge members 3, 4. As shown in FIG. 7, key contact points 6*c* and a circuit pattern 6*d* are printed on the upper surface of the holder member 6 via an insulating layer. Although not shown in the drawings, key contact points are provided on the holder member 6 for each key of the keyboard, and on rubber spring is attached on the holder member 6 at a position corresponding to each pair of key contact points. The key contact points 6*c* and the rubber spring 31 of the space key 1 of the present embodiment are disposed in the approximate lengthwise center of the key top 2.

The holding portions 6*a*, 6*a* and the holding portions 6*b*, 6*b* are formed in the holding member 6 by press working. As mentioned above, the holding portions 6*a*, 6*a* are for pivotably supporting the pair of holding pins 3*d*, 3*d* of the hinge member 3 and the pair of holding portions 6*b*, 6*b* are for slidably supporting the pair of holding pins 4*d*, 4*d* of the hinge member 4. The link members 3*b*, 4*b* provided at ends of the hinge members 3, 4 are sufficiently resilient in nature because they are formed in a slender rod shape from polyacetal resin (POM). When assembling the key switch 1, the pairs of holding pins 3*d*, 4*d* of the link members 3*b*, 4*b* are bent inward toward each other and inserted into the holding portions 6*a*, 6*b* of the holder member 6. Because the link members 3*b*, 4*b* are sufficiently resilient, they will not break when bent inward to be inserted into the holding portions 6*a*, 6*b*.

Here, an explanation will be provided for a switching operation of the key switch 1. The rubber spring 31 constantly urges the key top 2 upward so that as long as the key top 2 is not pressed downward, the key top 2 will be disposed at its uppermost disposition as shown in FIGS. 6 and 7. In other words, because the pressing portion 3*j* of the hinge member 3 is mounted on the upper surface of the rubber spring 31, the hinge members 3 and 4 of the guide support member 5 are urged upward by the rubber spring 31 so that the key top 2 is disposed at its uppermost disposition.

On the other hand, when the upper surface of the key top is pressed downward, the holding pins 3*a*, 3*d*, 4*d* and the holding holes 4*a* of the guide support member 5 pivot or slide with respect to the holding portions 6*a*, 6*b* formed in the holder member 6 and in the under surface of the key top 2. As a result, the link members 3*b*, 4*b* will pivot with respect to each other in a scissors-like movement so as to support the key top 2 in a horizontal posture while the key top 2 moves downward. In association with the downward movement of the key top 2, the depression portion 3*j* of the guide support member 5 also moves downward so as to gradually press down against the rubber spring 31. When the key top 2 is pressed down and moves downward accordingly, the upper inner surface of the rubber spring 31 will contact the key contact point 6*c* printed on the upper surface of the holder member 6. When the rubber spring 31 contacts the key contact points 6*c*, a circuit including the key contact point 6*c* is completed so that a switching operation is performed as shown in FIG. 8.

When downward pressure on the key top 2 is released, the depression portion 3*j* of the guide support member 5 is raised upward by urging force of the rubber spring 31. When the depression portions 3*j* rises upward, the holding pins 3*a*, 3*d*, 4*d* and the holding holes 4*a* of the guide support member 5 pivot and slide with respect to the holding portions 6*a*, 6*b* in the opposite directions from when the key top 2 was pressed down. As a result, the link members 3*b*, 4*b* pivot about each other in the manner of a pair of scissors closing so as to raise the key top 2 upward while maintaining the key top 2 in a horizontal posture. The key top 2 will continue rising upward until either the rubber spring 31 rises to its uppermost limit or the sliding holder pins 3*a*, 4*d* abut against the side walls of the holding portions 6*b*, 6*b*, whereupon the key top 2 will be in its uppermost disposition shown in FIG. 6 of before it was pressed downward.

As mentioned previously, the connection member 3*c*, 4*c* of the guide support member 5 have significant rigidity from being formed in a thick plate shape or a thick rod shape and so have higher rigidity than any of the link members 3*b*, 4*b*. The connection member 3*c* is configured to have especially high rigidity by being press fitted with the rigid metal wire 3*g* following its lengthwise direction. This is desirable because the connection member 3*c* is provided with the depression portion 3*j* for directly pressing against the rubber spring 31, so it is particularly important that the connection member 3*c* not bend during switching operations. Because the key switch 1 is supported by the guide support member 5 having these connection members 3*c*, 4*c*, even when a lengthwise end of the key top 2 is pressed downward, the connection members 3*c*, 4*c*, particularly the connection member 3*c* which presses directly on the rubber spring 31, will enable a proper switching operation without bending.

Figure 8:
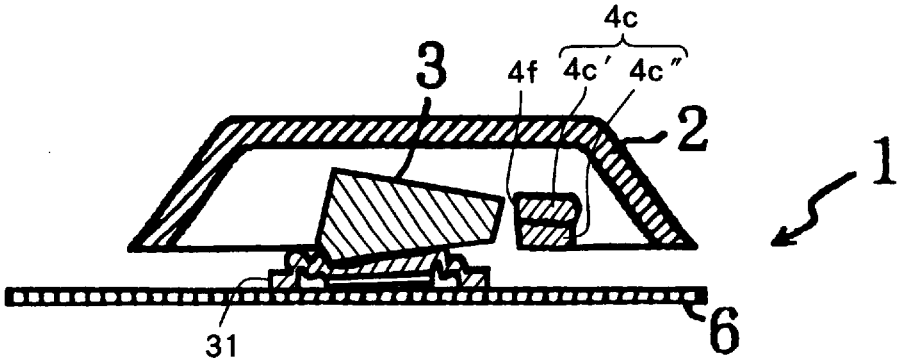
FIG. 8 is a cross-sectional view taken along line VII—VII of FIG. 5(*b*) wherein a key top of the key switch is pressed down to perform a switching operation.

In order to provide sufficient stroke for the switching operation of the key switch 1, the connection members 3*c*, 4*c* must be thin enough to fit completely within the key top 2 when the key top 2 is in its lower most position, that is, when the rubber spring 31 contacts the key contact point 6*c* as shown in FIG. 8. Therefore, there is a limit to how thick the connection members 3*c*, 4*c* can be formed without reducing the stroke of the key switch 1. In the present embodiment, the connection members 3*c*, 4*c* are formed in the maximum thickness that can be housed within the key top 2. However, this maximum thickness by itself may not provide the connection members 3*c*, 4*c* with rigidity to sufficiently prevent bending during a switching operation. Any lack of rigidity caused by this restriction in thickness of the connection members 3*c*, 4*c* is supplemented by the metal wire 3*g* press fitted into the connection member 3*c*. It should be noted that another metal wire can be press fitted into the connection member 4*c* as well.

Next, a second embodiment of the present invention will be described while referring to FIGS. 12 and 13. A key switch according to the second embodiment includes a hinge member 13, which is a modification of the hinge member 3 of the first embodiment. Other components of the key switch according to the second embodiment are the same as those described in the first embodiment so their description will be omitted.

Figure 12:
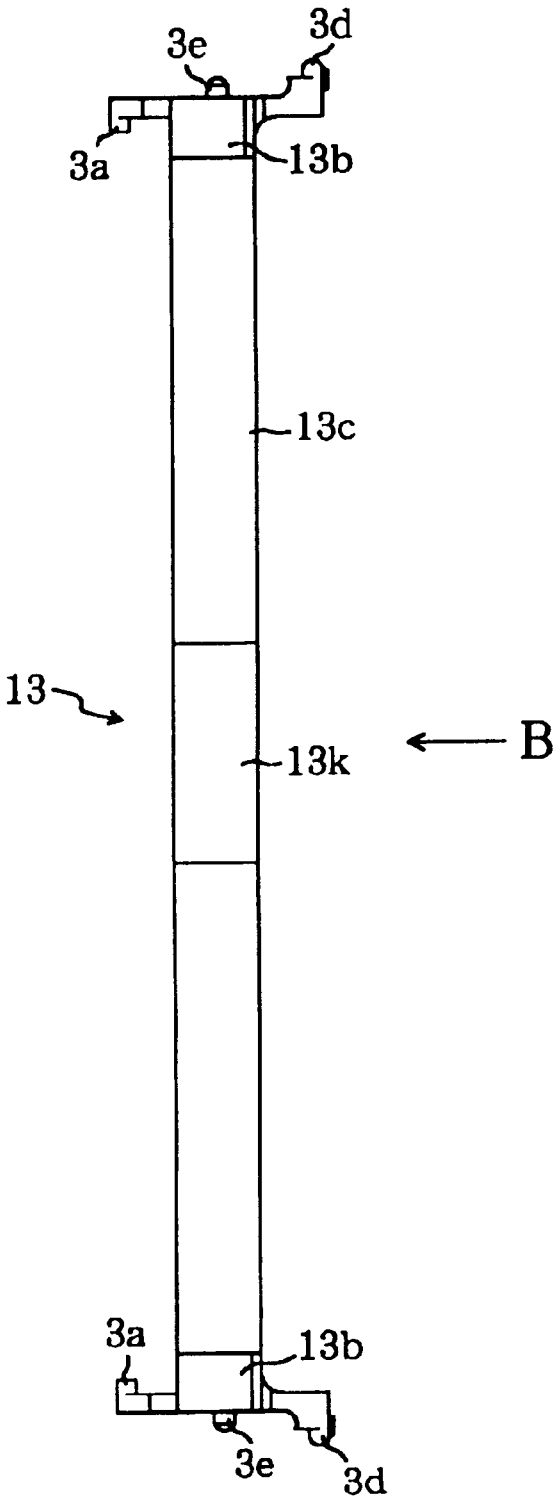
FIG. 12 is a plan view showing a hinge member according to a second embodiment of the present invention.
Figure 13:
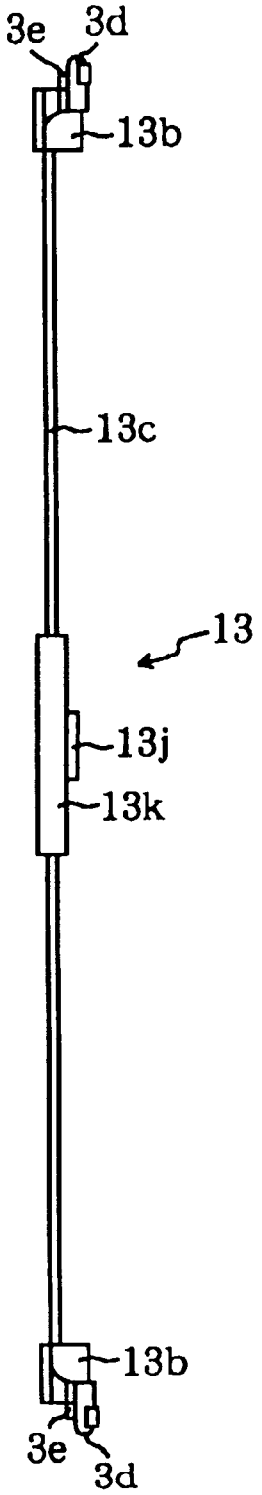
FIG. 13 is a side view of the hinge member of FIG. 12 as viewed in a direction indicated by an arrow B in FIG. 12.

FIG. 12 is a plan view showing the hinge member 13 of the second embodiment. FIG. 13 is a side view of the hinge member 13 as viewed from a direction indicated by an arrow B in FIG. 12. The hinge member 13 has an approximately H shape as viewed in FIG. 12 and includes a metal connection member 13*c* formed in a thin plate shape from cold-rolled steel plate (SPCC) and a pair of link members 13*b*, 13*b* formed from resilient polyacetal resin (POM) onto opposite tip ends of the connection member 13*c*. A pressing member 13*k* having a downward protruding pressing portion 13*j* is formed from resilient polyacetal resin (POM) onto the connection member 13*c* near the center of the connection member 13*c*. The pressing portion 13*j* of the pressing member 13*k* is mounted on the upper surface of the rubber spring 31 so that when the key top 2 is pressed downward, the pressing portion 13*j* presses directly downward on the rubber spring 31. The link members 13*b*, 13*b* and the pressing member 13*k* are formed onto the connection member 13*c*, for example, by molding the resin material around the connection member 13*c* into the shape of the link members 13*b*, 13*b* and the pressing member 13*k*.

Because the link members 13*b*, 13*b* and the pressing member 13*b* are fitted on the connection member 13*c*, the connection member 13*c* need not be formed from the same resilient material. Therefore, the connection member 13*c* of the hinge member 13 according to the second embodiment can be formed from a rigid metal in a plate shape so that even when a lengthwise end of the key top 2 is pressed downward, a proper switching operation can be performed without the connection member 13*c* bending in an undesirable manner. In addition, because the link members 13*b*, 13*b* are formed from a resilient resin material, they can be easily bent during attachment of the hinge member 13 into the holder member 6 without breaking.

Figure 14:
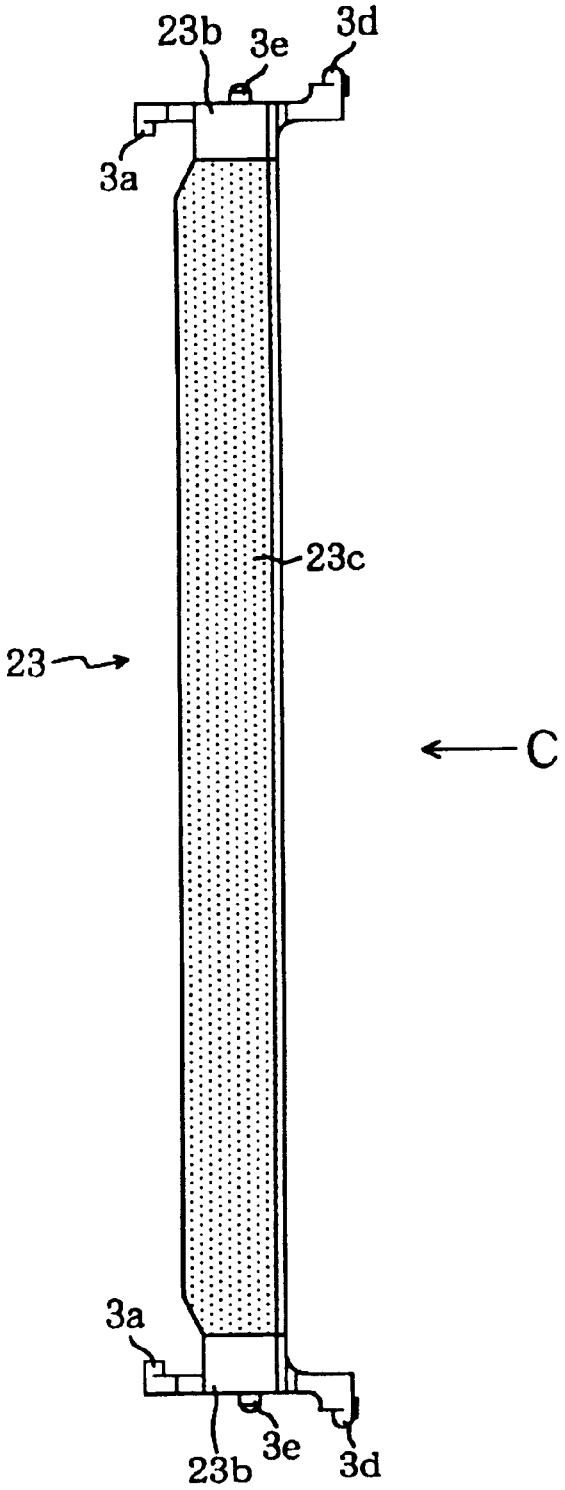
FIG. 14 is a plan view showing a hinge member according to a third embodiment of the present invention.
Figure 15:
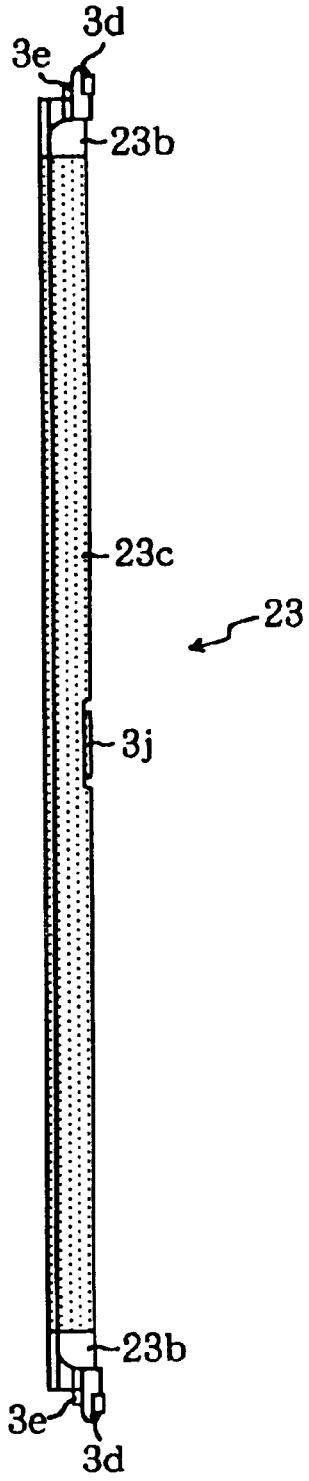
FIG. 15 is a side view of the hinge member in FIG. 14 as viewed in a direction indicated by an arrow C in FIG. 14.

Next, an explanation will be provided for a third embodiment of the present invention while referring to FIGS. 14 and 15. A key switch according to the third embodiment includes a hinge member 23, which is a modification of the hinge member 3 of the first embodiment. Other components of the key switch according to the third embodiment are the same as those of the key switch 1 described in the first embodiment so their description will be omitted.

FIG. 14 is a plan view of the hinge member 23 according to the third embodiment. FIG. 15 is a side view of the hinge member 23 as viewed in a direction indicated by an arrow C in FIG. 14. The hinge member 23 of the third embodiment includes a connection member 23*c* and the link members 23*b* that are formed from different materials that are attached together during molding processes. Alternatively, the connection member 23*c* and the link members 23*b* could be connected by adhesive. The link members 23*b* are formed from resilient polyacetal resin (POM) as described in the first embodiment. On the other hand, the connection member 23*c* is formed from a rigid polyacetal resin (POM) mixed with glass fibers to increase its rigidity and strength. Because the rigidity of the connection member 23*c* is increased in this way, even when the key top 2 is pressed downward at lengthwise edges thereof, a proper switching operation can be performed without the connection member 23*c* bending in an undesirable manner.

While the invention has been described in detail with reference to specific embodiments thereof, it would be apparent to those skilled in the art that various changes and modifications may be made therein without departing from the spirit of the invention, the scope of which is defined by the attached claims.

For example, the embodiments describe the scissors-like pivoting movements of the guide support member 5 resulting from the axial protrusions 3*e* of the hinge members 3, 13, 23 being pivotably fitted in the axial holes 4*e*, 4*e* of the hinge member 4. However, scissors-like pivoting movements can be generated by coupling the hinge members of the guide support member in a different manner. For example, scissors-like pivoting members can be generated between two hinge members when the axial hole of one of the hinge members is formed in an elongated shape and the hinge members are coupled together by slidably fitting the axial protrusion of the other hinge member into the elongated axial hole. Further, the embodiments describe the guide member 5 as being supported with respect to the key top 2 and the holder member 6 via various pin, slot, and hole configurations. However, the configurations shown in the drawings and described in the embodiments are only examples. The pins, slots, and holes could be arranged differently or other configurations without pins, slots, or holes could be used instead. In other words, any configuration that enables scissors-like pivotable movements between the hinge members and movement of the key top toward the holder member is satisfactory for the present invention.

Although the embodiments describe a rubber spring 31 being pressed downward by the guide support member, instead a protrusion could be provided to the under surface of the key top 2 so that the rubber spring 31 is pressed downward by this protrusion.

Also, the embodiments describe the hinge member 3, 13, 23 as being formed from polyacetal resin (POM). However, the hinge members could instead being formed from resilient polybutylene terephthalate (PET) resin, or polyamide (PA) resin instead.

The embodiments describe the present invention applied to a space key, but the present invention could be used with any elongated key switch.

An elongated key support mechanism according to the present invention has link members connected by a rigid connection member. Therefore, even if the elongated key is pressed downward at a lengthwise in thereof, a proper switching operation can be performed without the connection member bending.

Further, the wire 3*g* can be attached to the connection member 3*c* by a variety of methods other than press fitting. For example, the wire 3*g* could be attached to the connection member 3*c* by adhesive. Alternatively, the wire 3*g* could be incorporated into the connection member 3*c* during formation of the connection member 3*c*.

What is claimed is:

1. An elongated key support mechanism comprising:

an elongated key top having a length extending in a lengthwise direction and a width extending in a widthwise direction, the length being greater than the width, the key top having two widthwise edges opposite each other with respect to the widthwise direction and having a lower surface;

a first holding portion provided on the lower surface of the key top adjacent to one of the widthwise edges;

a second holding portion provided on the lower surface of the key top adjacent to another of the widthwise edges;

a holder member having a third holding portion confronting the first holding portion and a fourth holding portion confronting the second holding portion; and a guide support member including:

a first pair of link members supported between the first and fourth holding portions;

a first connection member that extends in the lengthwise direction and that connects the first pair of link members together;

a second pair of link members supported by the second and third holding portions;

a second connection member that extends in the lengthwise direction and that connects the second pair of link members together; wherein:

the first and second pairs of link members are coupled together to enable scissor-like pivoting movements of the first and second pairs of link members to guide movement of the key top toward and away from the holder member, and at least one of the first and second connection members has a rigidity greater than a rigidity of any link member of the first and second pairs of link members.

2. An elongated key support mechanism as claimed in claim 1, further comprising an elongated rigid member attached to the at least one of the first and second connection members so as to extend in the lengthwise direction.

3. An elongated key support mechanism as claimed in claim 2, wherein the at least one of the first and second connection members is formed with an elongated groove extending in the lengthwise direction, the elongated rigid member being fitted in the elongated groove.

4. An elongated key support mechanism as claimed in claim 3, wherein the at least one of the first and second connection members is formed with protrusions extending into the elongated groove, the protrusions preventing the elongated rigid member from falling out of the elongated groove.

5. An elongated key support mechanism as claimed in claim 4, wherein the at least one of the first and second connection members is formed with through holes extending from the groove to a surface of the at least one of the first and second connection members opposite the groove.

6. An elongated key support mechanism as claimed in claim 6, wherein the at least one of the first and second connection members is formed from a metal material and the first and second pair of link members are formed from a resin material.

7. An elongated key support mechanism as claimed in claim 6, further comprising:

a switching member for performing a switching operation in association with movement of the key top toward the holder member as guided by the guide support member, the switching member including:

key contacts disposed on the holder member under the key top;

a rubber spring disposed between the key contacts and the at least one of the first and second connection members; and a pressing member formed from a resin material and fitted on the at least one of the first and second connection members at a position confronting the rubber spring.

8. An elongated key support mechanism as claimed in claim 1, wherein the first and second pair of link members are formed from a resin material and the at least one of the first and second connection members is formed from a resin material including a reinforcing material to increase rigidity of the at least one of the first and second connection members.

9. An elongated key support mechanism as claimed in claim 8, wherein the reinforcing material included in the resin material of the at least one of the first and second connection members is glass fiber.

10. An elongated key support mechanism as claimed in claim 1, further comprising a switching member for performing a switching operation in association with movement of the key top toward the holder member as guided by the support member.

11. An elongated key support mechanism as claimed in claim 10, wherein the switching member includes:

key contacts disposed on the holder member under the key top; and a rubber spring disposed between the key contacts and the at least one of the first and second connection members.

12. An elongated key support mechanism as claimed in claim 1, wherein the at least one of the first and second connection members is formed in an elongated plate shape.

13. An elongated key support mechanism as claimed in claim 1, wherein the first and second pair of link members are formed in elongated rod shapes.

14. An elongated key support mechanism as claimed in claim 1, wherein the first connection member is formed thinner at ends thereof connecting with the first pairs of link members than at a central portion thereof so that the first connection member does not abut against the second pair of link members during scissor-like movements of the first and second pairs of link members.

15. An elongated key support mechanism comprising:

an elongated key top having a length extending in a lengthwise direction and a width extending in a widthwise direction, the length being greater than the width, the key top having two widthwise edges opposite each other with respect of the widthwise direction and having a lower surface;

a first holding means provided on the lower surface of the key top adjacent to one of the widthwise edges;

a second holding means provided on the lower surface of the key top adjacent to another of the widthwise edges;

a holder means having a third holding means confronting the first holding means and a fourth holding means confronting the second holding means; and a guide means including:

a first pair of link means supported between the first and fourth holding means;

a first connection means extending in the lengthwise direction and connecting the first pair of link means together;

a second pair of link means supported by the second and third holding means; and a second connection means extending in the lengthwise direction and connecting the second pair of link means together, wherein the first and second pairs of link means are coupled together to enable scissor-like pivoting movements of the first and second pairs of link means to guide movement of the key top toward and away from the holder means, and at least one of the first and second connection means has a rigidity greater than a rigidity of any link means of the first and second pairs of link means.

16. An elongated key support mechanism as claimed in claim 15, further comprising an elongated rigid means attached to the at least one of the first and second connection means so as to extend in the lengthwise direction.

17. An elongated key support mechanism as claimed in claim 15, wherein the at least one of the first and second connection means is formed from a metal material and the first and second pair of link means are formed from a resin material.

18. An elongated key support mechanism as claimed in claim 15, wherein the first and second pair of link means are formed from a resin material and the at least one of the first and second connection means is formed from a resin material including a reinforcing material to increase rigidity of the at least one of the first and second connection means.

19. An elongated key support mechanism as claimed in claim 15, further comprising a switching means for performing a switching operation in association with movement of the key top toward the holder means as guided by the guide means.

20. An elongated key support mechanism as claimed in claim 19, wherein the switching means includes:

key contacts disposed on the holder means under the key top; and a rubber spring disposed between the circuit points and the at least one of the first and second connection means.

* * * * *